US008276230B2

(12) United States Patent
Kim

(10) Patent No.: US 8,276,230 B2
(45) Date of Patent: Oct. 2, 2012

(54) OPERATING METHOD OF LAUNDRY DEVICE

(75) Inventor: Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1156 days.

(21) Appl. No.: 10/553,129

(22) PCT Filed: May 24, 2005

(86) PCT No.: PCT/KR2005/001517

§ 371 (c)(1),
(2), (4) Date: Dec. 12, 2006

(87) PCT Pub. No.: WO2005/115095

PCT Pub. Date: Dec. 8, 2005

(65) Prior Publication Data

US 2007/0169282 A1 Jul. 26, 2007

(30) Foreign Application Priority Data

May 31, 2004 (KR) ..... 10-2004-0039115
May 31, 2004 (KR) ..... 10-2004-0039116
May 31, 2004 (KR) ..... 10-2004-0039117

(51) Int. Cl.
*D06B 19/00* (2006.01)

(52) U.S. Cl. ..... 8/149.3; 8/158

(58) Field of Classification Search ..... 8/149.3, 8/158, 159
See application file for complete search history.

(56) References Cited

U.S. PATENT DOCUMENTS

| | | | | |
|---|---|---|---|---|
| 1,711,162 | A * | 4/1929 | Woelfel | 8/137 |
| 4,527,343 | A | 7/1985 | Danneberg | |
| 6,401,284 | B1 * | 6/2002 | Jeon et al. | 8/158 |
| 2002/0133886 | A1 | 9/2002 | Severns et al. | |
| 2004/0019977 | A1 * | 2/2004 | Goddard et al. | 8/159 |
| 2004/0187527 | A1 * | 9/2004 | Kim et al. | 68/5 C |

FOREIGN PATENT DOCUMENTS

| | | | |
|---|---|---|---|
| CN | 1074258 | | 7/1993 |
| CN | 1165883 | | 11/1997 |
| EP | 1275767 | A1 * | 1/2003 |
| JP | 2161997 | A | 6/1990 |
| JP | 4-158896 | | 6/1992 |
| JP | 4-347199 | | 12/1992 |
| JP | 2003-93775 | | 4/2003 |
| JP | 2003-311084 | A | 11/2003 |

(Continued)

*Primary Examiner* — Michael Barr
*Assistant Examiner* — David Cormier
(74) *Attorney, Agent, or Firm* — McKenna Long & Aldridge LLP

(57) ABSTRACT

Method for operating a laundry device including a sterilizing step for supplying steam to an inside of a drum having laundry introduced thereto for progressing sterilizing and/or soaking of the laundry, a washing water supply step for supplying washing water to an inside of the drum having the laundry introduced thereto according to an amount of the laundry, a washing step for rotating the drum for a preset time period to perform washing, a rinsing step for performing rinsing at least once upon finish of washing, and a spinning step for performing a final spinning cycle upon finish of the rinsing, which are to be progressed in succession, whereby consuming small amount of washing water, and power in soaking the laundry, and enabling sterilizing of the laundry having washing thereof finished.

8 Claims, 9 Drawing Sheets

FOREIGN PATENT DOCUMENTS

| | | |
|---|---|---|
| KR | 10-1997-0011098 | 3/1997 |
| KR | 1997-0009424 | 6/1997 |
| KR | 1999-0086550 | 12/1999 |
| KR | 2002-0057119 | 7/2002 |
| KR | 10-2005-0054697 | 6/2005 |
| WO | WO 95/08288 | 3/1995 |

* cited by examiner

OPERATING METHOD OF LAUNDRY DEVICE

This application claims priority to International Application No. PCT/KR2005/001517 filed on May 24, 2005, as well as Korean Applications P 2004-39115 filed on May 31, 2004, P 2004-39116 filed on May 31, 2004 and P 2004-39117 filed on May 31, 2004, all of which are incorporated by reference, as if fully set forth herein.

TECHNICAL FIELD

The present invention relates to laundry devices, and more particularly, to a method for operating a laundry device which can soak, wash, rinse, spin, sterilize laundry with a small amount of washing water and a low power consumption.

BACKGROUND ART

In general, in the laundry devices, there are pulsator washing machines each with an upstanding drum, drum type washing machines each with a horizontal drum, and laundry dryers.

As described, since the drum type washing machine has the horizontal drum, the drum type washing machine performs washing by dropping the laundry introduced in the drum.

FIGS. 1 and 2 illustrate diagram of related art drum type washing machines.

That is, the drum type washing machine is provided with a body 10, an outer tub 20 in the body 10, a drum 30 rotatably mounted in the outer tub 20, and driving means for driving the drum 30.

The body 10 has an opening 11 in a front surface for introduction of laundry, and a door 40 mounted at a side of the opening 11 for opening/closing the opening 11.

The opening 11 has a rim 50 on an inside circumference for sealing between the door 40 and the opening 11.

The outer tub 20 is supported on dampers 21 on opposite underside of an outside circumference of the outer tub 20.

In the driving means, there are a driving motor 71 for driving the drum 30, and a belt 72 for transmission of a driving power from the driving motor 71 to the drum 30.

However, the related art laundry device has a problem of high power consumption because the related art laundry device, not only consumes much washing water unnecessarily even in a case a small amount of laundry, or laundry with low contamination is washed, and a washing process in above washing takes substantially the same time period as a general washing process.

Particularly, even though soaking of laundry before washing is effective for a washing performance, in general, a soaking process is omitted in a general washing cycle due to substantial amount of washing water consumption, that causes to fail in obtaining the best washing performance.

Moreover, in the related art washing cycle, there has been no separate cycle for sterilizing the laundry.

Recently, even if washing which requires sterilizing without fail, such as baby clothes, is required, there is no such a cycle provided separately.

Of course, though not shown, recently, though there is a laundry device provided with a separate washing water heater for heating the washing water to make boiled washing available, because the sterilizing is made by boiling merely, that requires much washing water and power, the boiled washing has not been preferred.

Accordingly, a new cycle is required, in which the sterilizing of the laundry is possible with a small amount of washing water and a low power consumption.

DISCLOSURE

Technical Problem

An object of the present invention is to provide a method for operating a laundry device, in which a cycle for sterilizing and/or soaking of laundry is performed before washing.

Another object of the present invention is to provide a method for operating a laundry device, in which a cycle for sterilizing of laundry is performed in the middle of washing.

Another object of the present invention is to provide a method for operating a laundry device, in which sterilizing of laundry can be performed after washing is finished.

Technical Solution

The object of the present invention can be achieved by providing a method for operating a laundry device including a sterilizing step for supplying steam to an inside of a drum having laundry introduced thereto for progressing sterilizing and/or soaking of the laundry, a washing water supply step for supplying washing water to an inside of the drum having the laundry introduced thereto according to an amount of the laundry, a washing step for rotating the drum for a preset time period to perform washing, a rinsing step for performing rinsing at least once upon finish of washing, and a spinning step for performing a final spinning cycle upon finish of the rinsing, which are to be progressed in succession.

In another aspect of the present invention, a method for operating a laundry device includes a washing water supply step for supplying washing water to an inside of a drum having laundry introduced thereto according to an amount of the laundry, a washing step for rotating the drum for a preset time period to perform washing, an intermediate spinning step for draining residual washing water as well as spinning the drum at a high speed for making an intermediate extraction of water when the washing is finished, a sterilizing step for putting a steam supplying part into operation for spraying steam into the inside of the drum having the laundry introduced thereto for sterilizing the laundry when the intermediate spinning is finished, a rinsing step for performing rinsing at least once upon finish of sterilizing, and a final spinning step for performing a final spinning cycle upon finish of the rinsing, which are to be progressed in succession.

In another aspect of the present invention, a method for operating a laundry device includes a washing water supply step for supplying washing water to an inside of a drum having laundry introduced thereto, a washing step for rotating the drum for a preset time period to perform washing, an intermediate spinning step for draining residual washing water as well as spinning the drum at a high speed for making an intermediate extraction of water when the washing is finished, a rinsing step for performing rinsing at least twice upon finish of the intermediate spinning with cold and warm water alternately, and a final spinning step for performing a final spinning cycle upon finish of the rinsing, which are to be progressed in succession.

Advantageous Effects

The operation method of a laundry device in accordance with a preferred embodiment of the present invention has an advantage in that an overall washing performance can be improved because soaking of the laundry in the drum is performed with a small amount of water and power before actual washing is made.

Moreover, the operation method of a laundry device in accordance with a preferred embodiment of the present invention has an advantage in that user's satisfaction on washing performance can be improved because the laundry having water extracted therefrom before rinsing of the laundry is performed is sterilized with high temperature steam.

Moreover, the operation method of a laundry device in accordance with a preferred embodiment of the present invention has an advantage in that dirt can be separated from the laundry smoothly by progressing the rinsing step of rinsing the laundry with cold and warm water, alternately.

Moreover, the operation method of a laundry device in accordance with a preferred embodiment of the present invention has an advantage in that user's satisfaction on washing performance can be improved because refresh and sterilization of the laundry can be made by supplying high temperature steam to the laundry in the drum again for a short time period after finish of the washing.

Moreover, the operation method of a laundry device in accordance with a preferred embodiment of the present invention has an advantage in that the operation method is the most desirable in washing clothes for persons who are susceptible to infection of microbes, such as infants and patients, because the laundry is sterilized with high temperature steam.

BEST MODE

A method for operating a laundry device in accordance with preferred embodiments of the present invention will be described in more detail.

Figure 1:
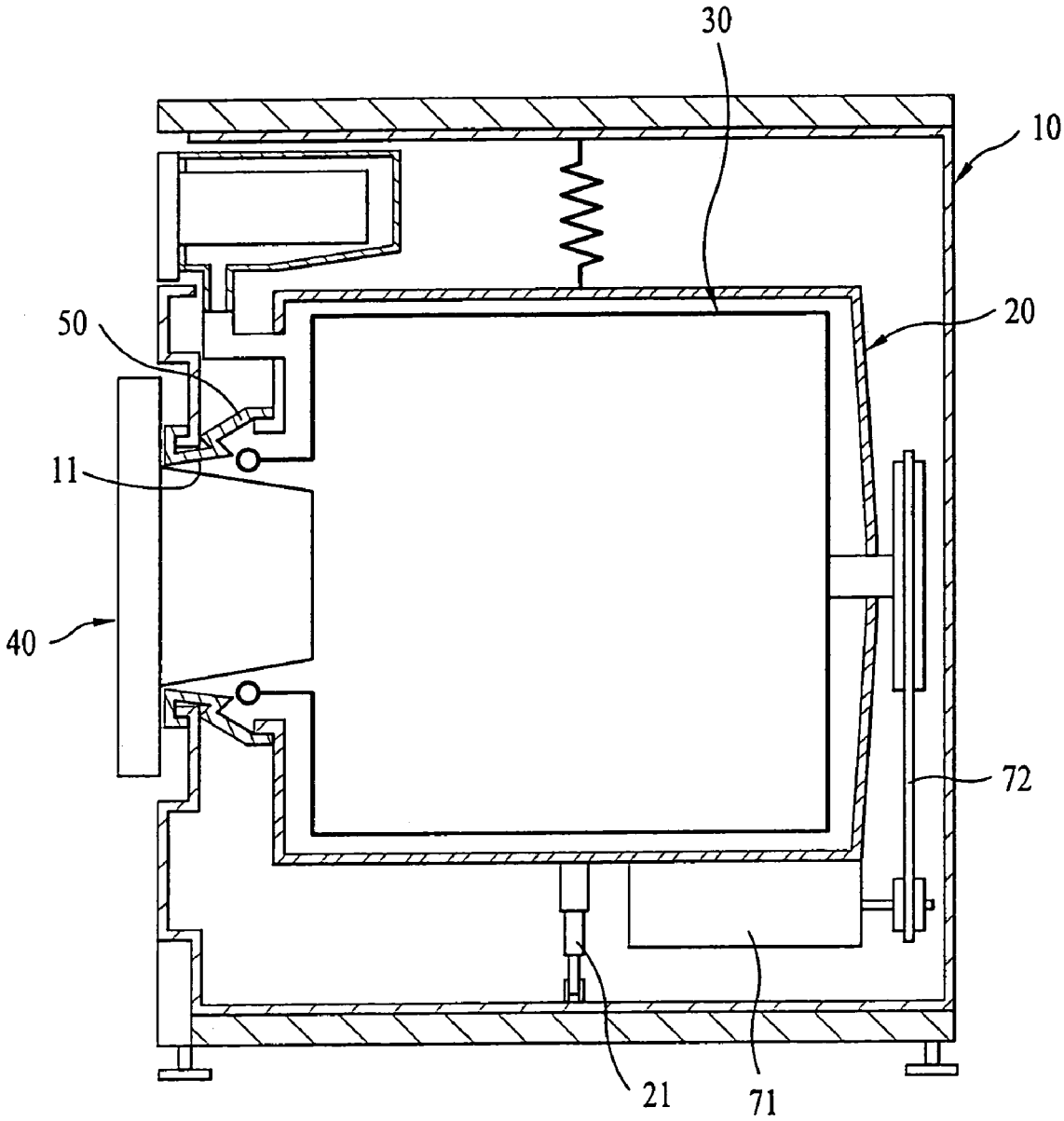
FIG. 1 illustrates a longitudinal section of a related art drum type washing machine.
Figure 2:
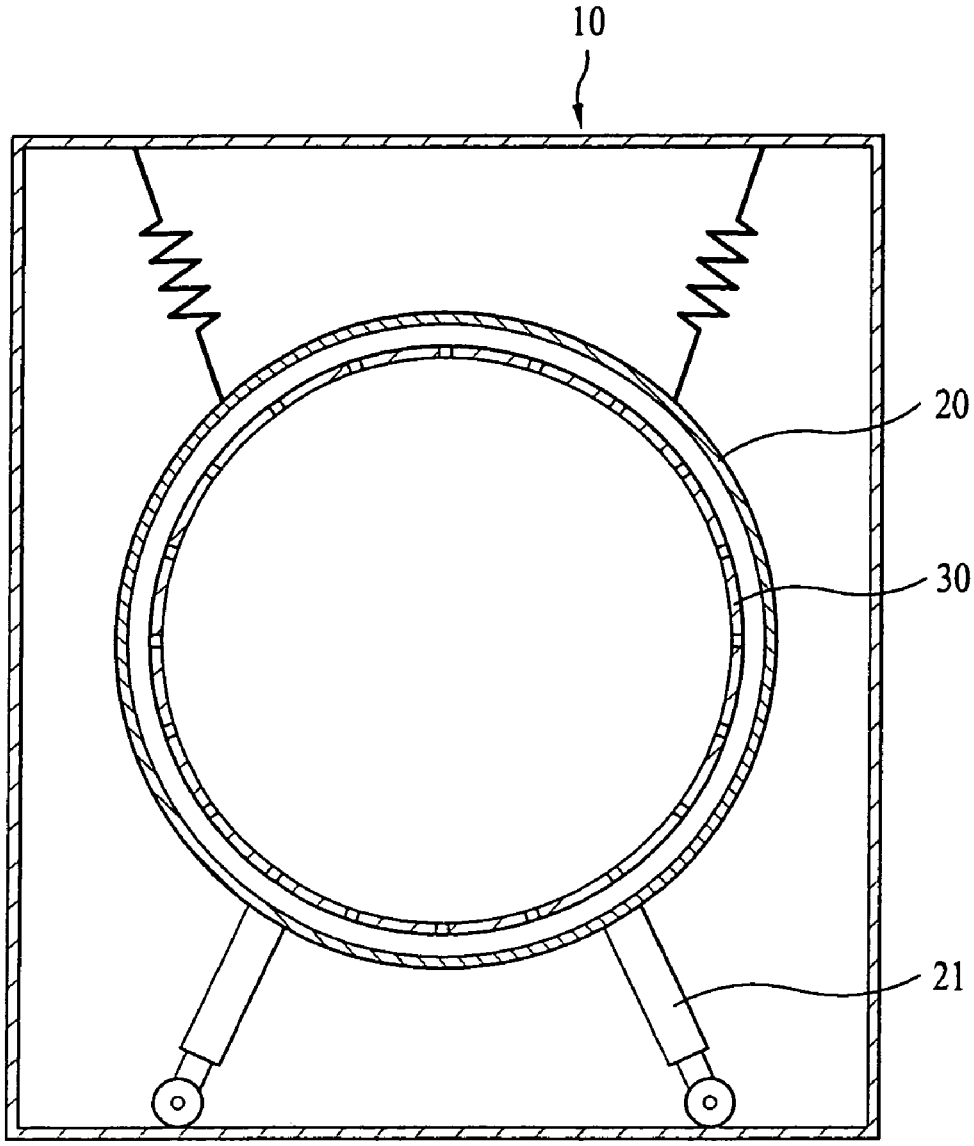
FIG. 2 illustrates a diagram showing a state of an inside structure of a related art drum type washing machine seen in front thereof, schematically.
Figure 3:
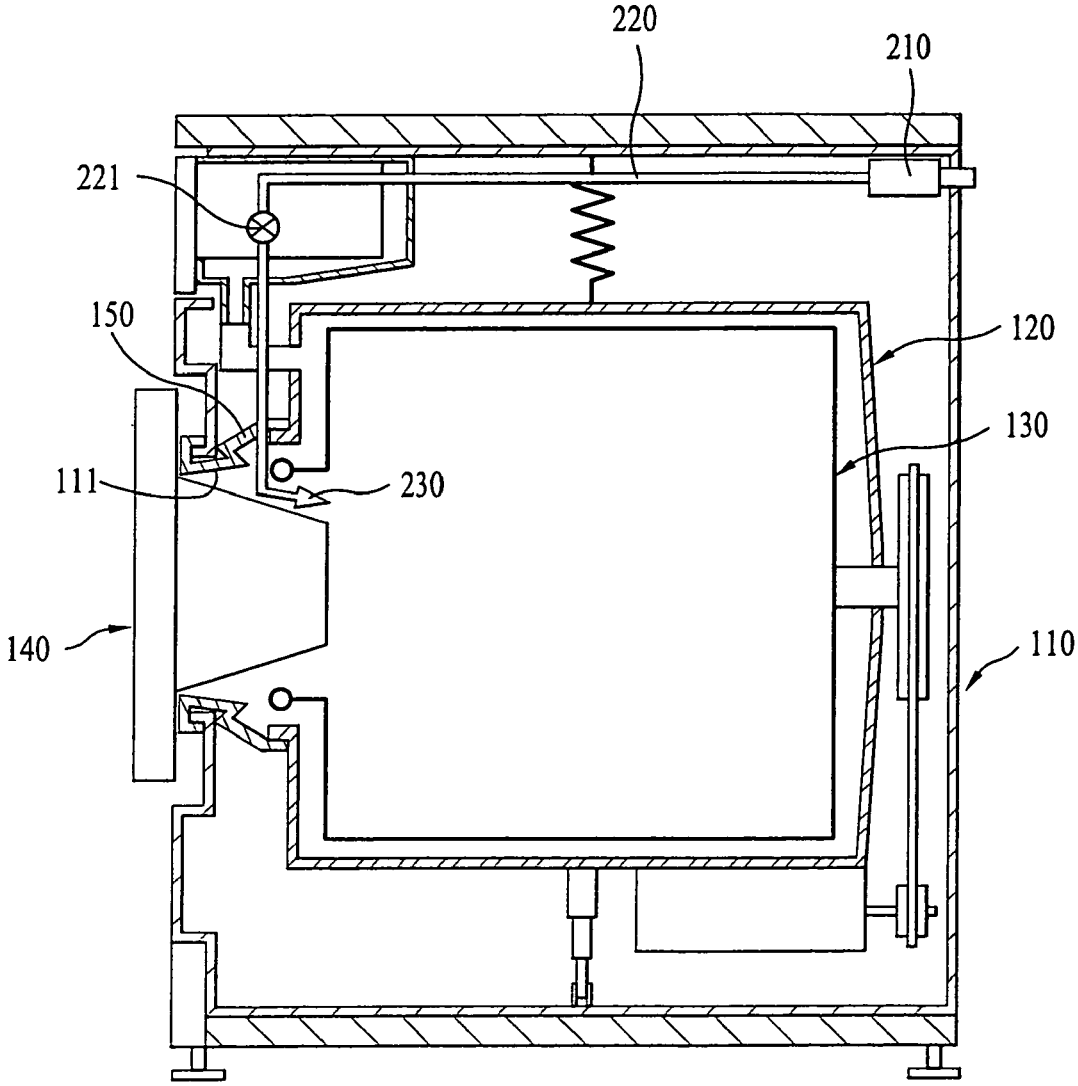
FIG. 3 illustrates a longitudinal section of a drum type washing machine in accordance with a preferred embodiment of the present invention.

Before starting description of the method for operating a laundry device in accordance with preferred embodiments of the present invention, a structure of the laundry device for performing the operation will be described with reference to FIG. 3.

As shown, the laundry device in accordance with a preferred embodiment of the present invention includes a body 110, an outer tub 120, a drum 130, and a steam supplying part.

The body 110 forms an exterior of the laundry device, and the outer tub 120 is supported on an inside of the body 110.

The body 110 has an opening 111 in a front surface, and a door mounted thereon for opening/closing the opening 111.

The drum 130 is rotatably mounted on an inside of the outer tub 120, and has an opening position to face the opening 111 in the body 110.

Between the opening 111 and the drum 130, there is a rim 150 for separating a space the laundry is to be introduced therein from a space of the body 110.

In a circumferential surface of the drum 130, there are pluralities of pass-through holes (not shown). The washing water and the steam are introduced into the drum 130 through the pass-through holes.

The steam supplying part is designed to supply steam to an inside of the drum 130. There may be at least two steam supplying parts.

The steam supplying part includes a heat generating portion 210 for providing heat to evaporate water, and a steam supply pipe 220 for flow of steam.

At a steam discharge side of the steam supply pipe 220, there is a spray nozzle 230 for spraying steam to the inside of the drum 130.

The spray nozzle 230 is mounted along the inside of the body 110, and the steam discharge side of the spray nozzle 230 is passed through the rim 150 such that the steam discharge side is in communication with the space inside of the drum 130.

Figure 4:
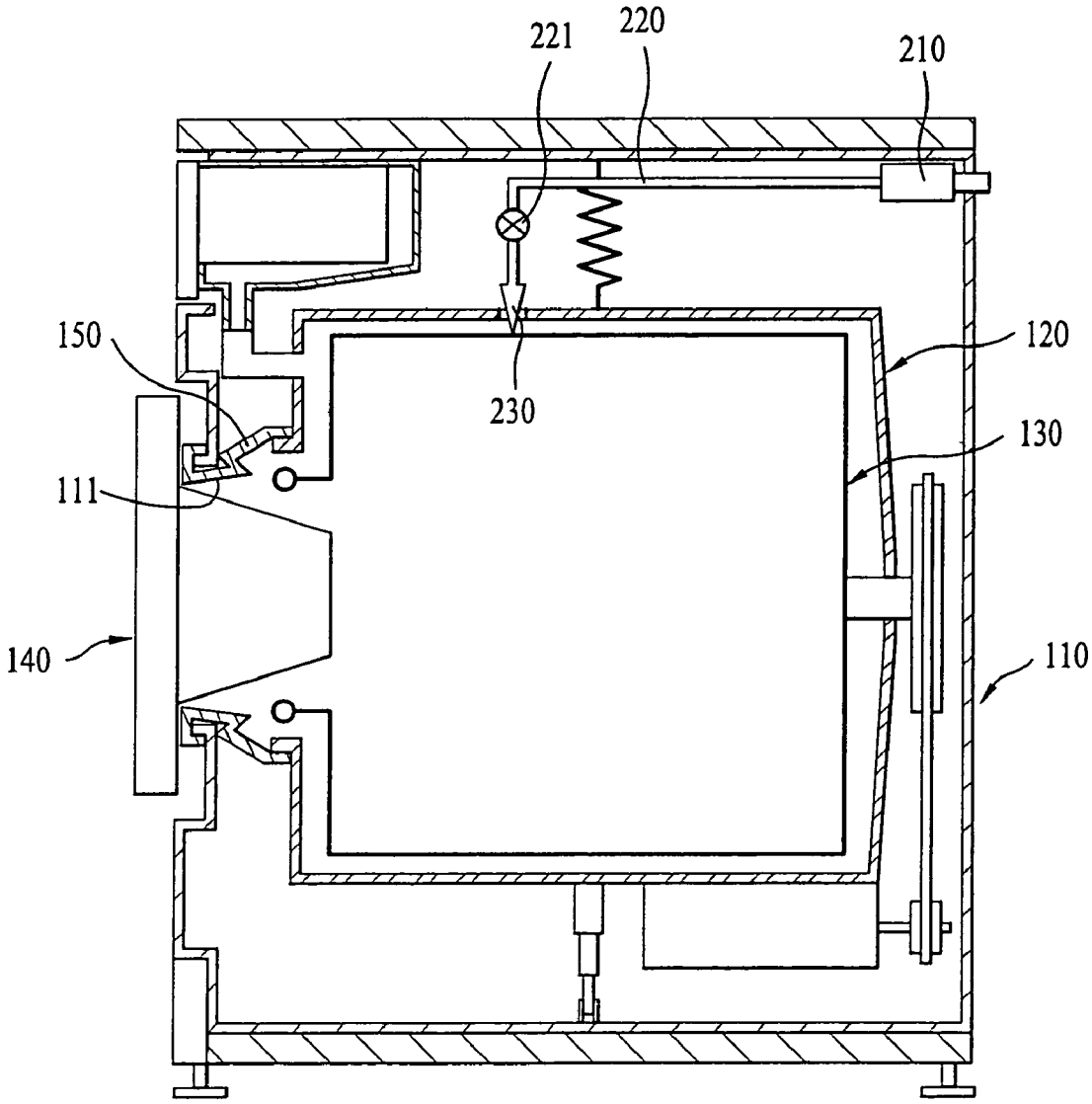
FIG. 4 illustrates a longitudinal section of a drum type washing machine in accordance with another preferred embodiment of the present invention.

Of course, referring to FIG. 4, the steam discharge side of the spray nozzle 230 is passed through the outer tub 120 such that the steam discharge side is in communication with the space inside of the outer tub 120.

In the pipeline of the steam supply pipe 220, an open/close valve 221 is provided. The open/close valve 221 opens/closes the pipeline of the steam supply pipe 220, selectively.

Figure 5:
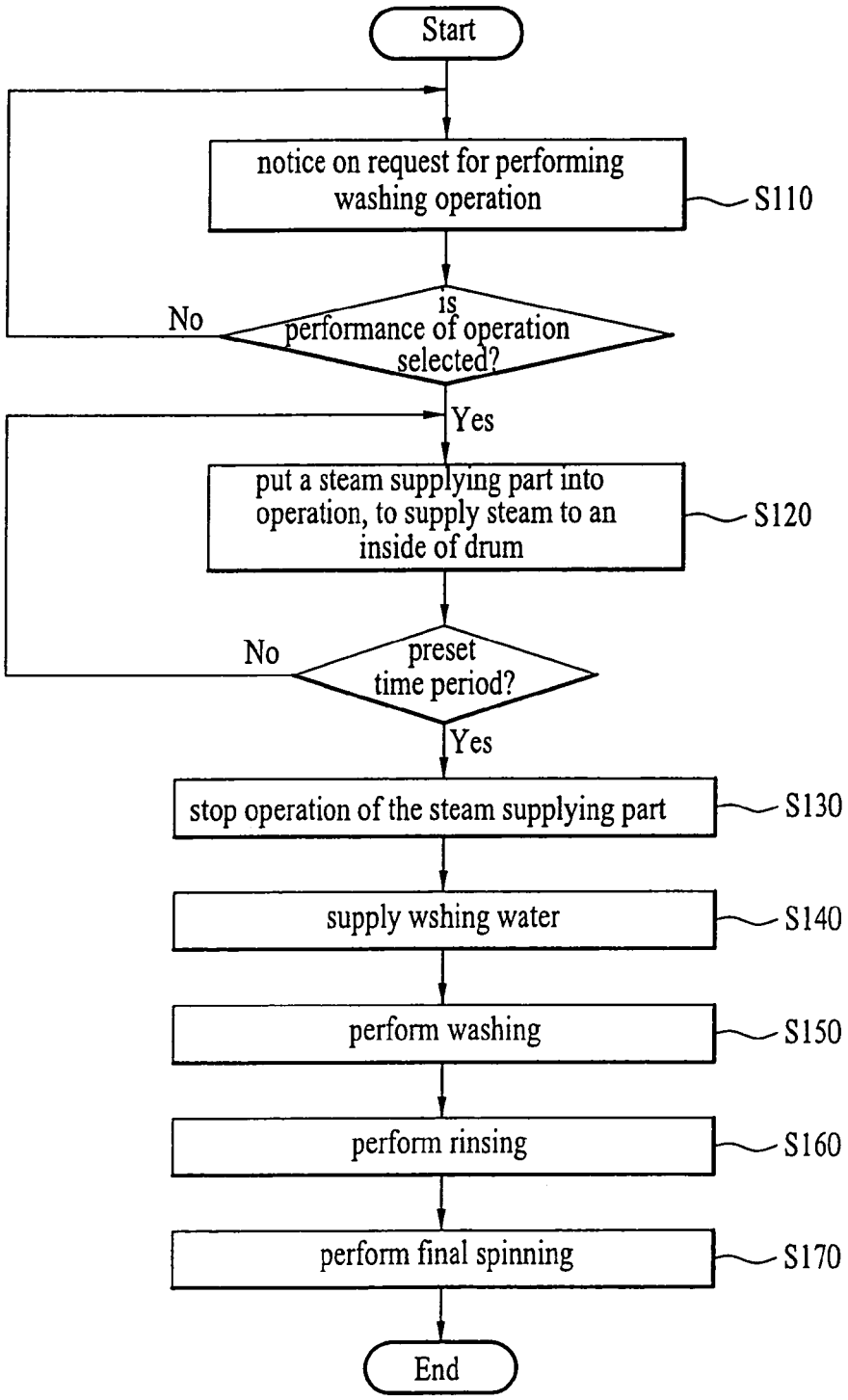
FIG. 5 illustrates a flow chart for describing an operating method in accordance with a first preferred embodiment of the present invention, schematically.

An operation method in accordance with a first preferred embodiment of the present invention of the laundry device of above structure which performs a washing cycle will be described with reference to the flow chart in FIG. 5.

The operation method of the laundry device in accordance with a first preferred embodiment of the present invention suggests to control such that laundry is sterilized as well as soaked with high temperature steam before progressing an actual washing.

The operation method is done as a sterilizing step, a washing water supply step, a washing step, a rinsing step, and a final spinning step are performed in succession, which will be described in more detail according to above order.

At first, a controller (not shown) for controlling operation of the laundry device receives a request for performing operation from a user (S110).

In this instance, it is required that the laundry has been introduced into the inside of the drum 130.

If the user requests for performing washing of laundry, at first, the controller progresses the sterilizing step for sterilizing laundry.

The sterilizing step is progressed by controlling (S120) such that the steam supplying part is controlled to generate steam, and, in succession, the generated steam is supplied to the inside of the drum 130.

That is, under the control of the controller, the heat generating portion 210 generates heat to evaporate water supplied to the steam supplying part, in which process the generated steam flows guided by the steam supply pipe 220, and sprayed to the inside of the drum 130 through the spray nozzle 230.

Since the steam is generated as water is evaporated with heat, the steam is in a substantially high temperature state (a temperature enough to kill microbes). Owing to this, the laundry in the drum 130 in contact with the steam is sterilized.

Moreover, it is preferable that the supply of the steam to the inside of the drum 130 is performed for a time period enough to soak the laundry in the drum 130.

If the supply of steam is performed for only a too short time period, the soaking of the laundry is failed, and if the supply of steam is performed for a too long time period, consumption of water and power may become too high compared to an effect of the soaking. Therefore, it is more preferable that the supply of steam is set shorter than a time period for a washing cycle.

According to above process, the laundry in the drum 130 becomes a state in which various kinds of dirt can be removed from the laundry, smoothly.

Upon finishing the sterilizing step made by supplying the steam, the controller controls (S130) to stop operation of the steam supplying part.

Along with this, the controller progresses the washing water supply step for supplying washing water.

The washing water supply step is a series of steps for supplying an appropriate amount of washing water to the inside of the drum 130 (S140), performed by controlling the water supply valve (not shown).

That is, as the water supply valve is operated, to open the water supply pipe (not shown), the washing water is supplied to an inside of the outer tub 120.

The appropriate amount of the washing water supplied to the drum 130 is a predetermined amount set according to an amount of the laundry.

It is preferable that an appropriate amount of detergent is also supplied to the inside of the drum 130 during the washing water is supplied to the drum 130 as the washing water supply step is progressed.

Of course, it may be controlled such that the detergent is supplied to the inside of the drum 130 during the sterilizing step is performed. This is because the steam can activate the detergent permeated in the laundry more.

Upon finishing the washing water supply step according to above steps, the controller performs the washing step (S150) of rotating the drum 130 for a preset time period, to wash the laundry.

That is, the washing water circulates by rotation of the drum 130, and as dirt stuck to the laundry is separated by composite actions of a friction force between the water circulation and the laundry occurred following the circulation of the washing water, softening action of the detergent, and so on, the laundry is washed.

In this instance, a rotation direction, speed of the drum 130, a cycle progress time period, and so on for progressing the washing step may be controlled the same with a general washing cycle, or may be controlled different from above depending on necessity.

Upon finishing the washing step, the rinsing step is performed (S160) for rinsing the laundry.

It is preferable that the rinsing step is performed at least once. If the rinsing step is performed for a plurality of times, it is preferable that draining, spinning, and re-supply of water, and so on are performed between adjacent rinsing steps, repeatedly.

Upon finishing the rinsing step, the final spinning step (S170) is performed for complete removal of water from the laundry.

In the final spinning step, the drum 130 spins at a high speed. Owing to this, the water is extracted from the laundry by a centrifugal force, and, in succession, discharged to an inside of the outer tub 20 through the pass-through holes in the drum 130.

As the final spinning step is finished thus, washing of the laundry is finished.

Figure 6:
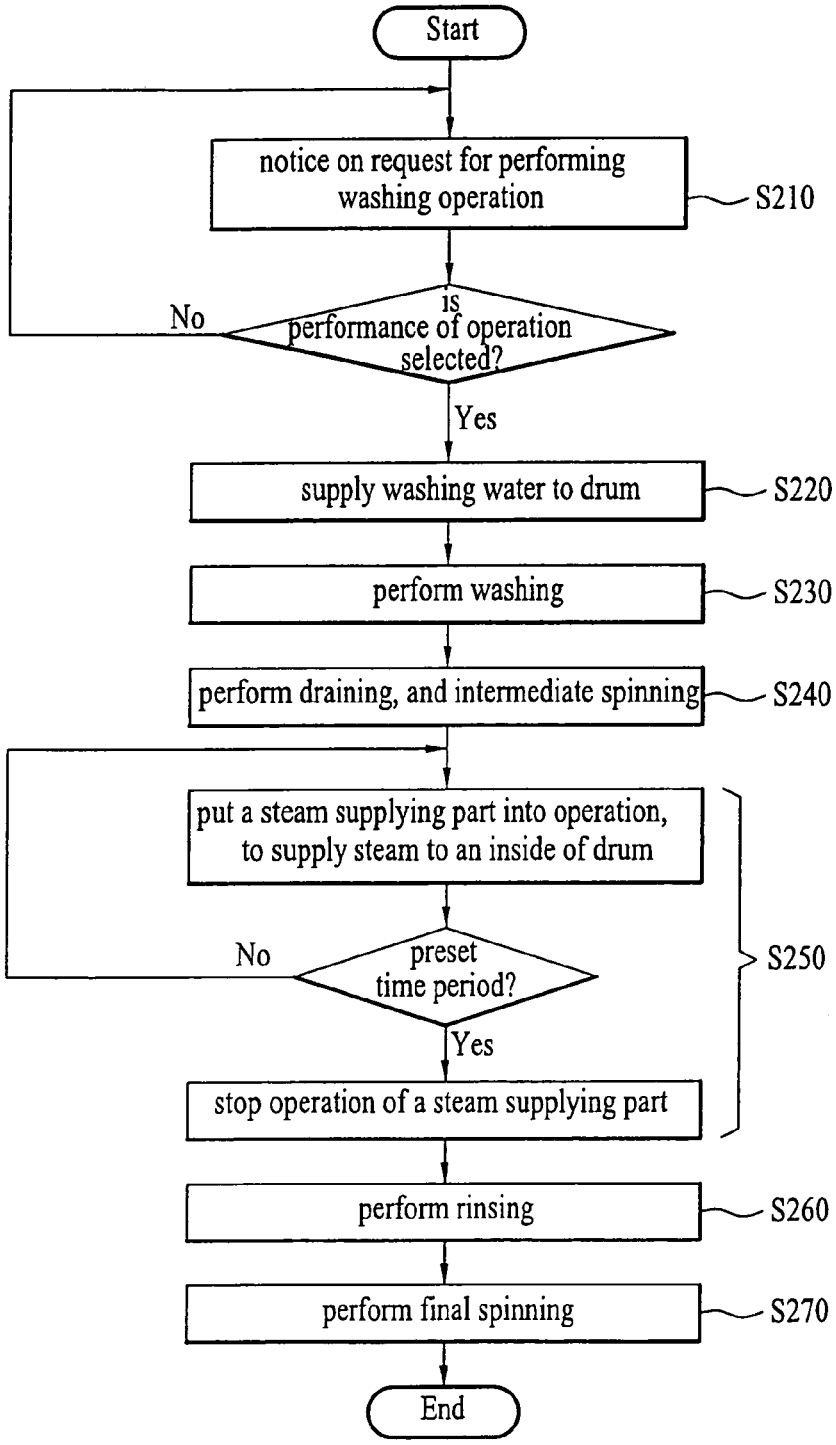
FIG. 6 illustrates a flow chart for describing an operating method in accordance with a second preferred embodiment of the present invention, schematically.

In the meantime, FIG. 6 illustrates a flow chart for describing an operating method of a laundry device in accordance with a second preferred embodiment of the present invention, schematically.

The operating method of a laundry device in accordance with a second preferred embodiment of the present invention suggests controlling such that a step of sterilizing laundry with steam is performed before rinsing is performed after washing of the laundry.

The operation method is done as a washing water supply step, a washing step, an intermediate spinning step, a sterilizing step, a rinsing step, and a final spinning step are performed in succession, which will be described in detail in above order.

At first, a controller (not shown) for controlling operation of the laundry device receives a request for performing operation from a user (S210).

In this instance, it is required that the laundry has been introduced into the inside of the drum 130.

If the user requests for performing washing operation, at first, the controller progresses the washing water supply step (S220).

The washing water supply step is a series of steps for supplying an appropriate amount of washing water to the inside of the drum 130 (S140), and performed by controlling the water supply valve (not shown).

That is, as the water supply valve is operated, to open the water supply pipe (not shown), the washing water is supplied to an inside of the outer tub 120.

The appropriate amount of the washing water supplied to the drum 130 is a predetermined amount set according to an amount of the laundry.

It is preferable that an appropriate amount of detergent is also supplied to the inside of the drum 130 during the washing water is supplied to the drum 130 as the washing water supply step is progressed.

Upon finishing the washing water supply step according to above steps, the controller performs the washing step (S230) of rotating the drum 130 for a preset time period, to wash the laundry.

That is, the washing water circulates by rotation of the drum 130, and as dirt stuck to the laundry is separated by composite actions of a friction force between the water circulation and the laundry occurred following the circulation of the washing water, softening action of the detergent, and so on, the laundry is washed.

In this instance, a rotation direction, speed of the drum 130, a cycle progress time period, and so on for progressing the washing step may be controlled the same with a general washing cycle, or may be controlled different from above depending on necessity.

Then, upon finishing the washing step by above steps, the controller progresses the intermediate spinning step (S240) for removing washing water from the laundry.

The intermediate spinning step is performed by spinning the drum 130 at a high speed after residual washing water is drained from the drum 130. During spinning of the drum 130, the residual washing water is kept drained from the drum 130.

This spinning of laundry is a step for smoother sterilization of the laundry in the following sterilizing step.

That is, a sterilizing effect is much better in a case high temperature steam is supplied to laundry containing a very small amount of water for sterilizing the laundry, than a case high temperature steam is supplied to laundry containing a large amount of water for sterilizing the laundry.

In a case the intermediate spinning is finished, the controller performs the sterilizing step for sterilizing the laundry (S250).

The sterilizing step is made by supplying high temperature steam to the laundry, when the laundry is heated to a high temperature quickly since the laundry is in a state almost all water is removed from the laundry, to sterilize the laundry from various microbes on the laundry, smoothly.

The high temperature steam for the sterilizing step is generated by controlling operation of the steam supplying part.

If the heat generating portion 210 generates heat under the control of the controller, a predetermined amount of steam is generated as water supplied to the steam supplying part evaporates, flows guided by the steam supply pipe 220, and sprayed into an inside of the drum 130 through the spray nozzle 230.

Particularly, the steam has a temperature which enables sterilizing of the laundry. The temperature which enables sterilizing of the laundry is a temperature higher than 60° C. (preferably, 70° C.).

Moreover, it is controlled such that the supply of steam is performed continuously for a time period (for an example, a time period of 3~10 minutes) enough to sterilize the laundry in the drum 130 of various microbes, adequately.

Of course, supply of steam for a too long time period is not preferable because water and power consumption can be great in comparison to the sterilizing effect.

Thus, by supplying high temperature steam for the predetermined time period, the laundry in the drum 130 is sterilized.

When the sterilizing step is finished, the controller operates the open/close valve 221, to cut off the pipeline of the steam supply pipe 220, to supply the steam no more, and turns off a power source for the heat generating portion 210.

Then, the controller performs the rinsing step for rinsing the laundry (S260).

It is preferable that the rinsing step is performed at least once. If the rinsing cycle is a plurality of times, draining, spinning, water re-supply, and so on are performed repeatedly.

In the rinsing step, water re-supply to the outer tub 120, and rotation of the drum 130 are performed, and the rinsing step is performed for a time period which is in general shorter than the washing step.

Upon finishing the rinsing step, the final spinning step is performed for removal of water from the laundry (S270).

The final spinning step is performed by draining washing water from the outer tub 120 completely, and spinning the drum 130 at a high speed. Owing to this, the water is discharged from the laundry to the inside of the outer tub 120 through the pass-through holes in the drum 130 by centrifugal force.

Upon finishing the final spinning step, washing of the laundry is finished.

Figure 7:
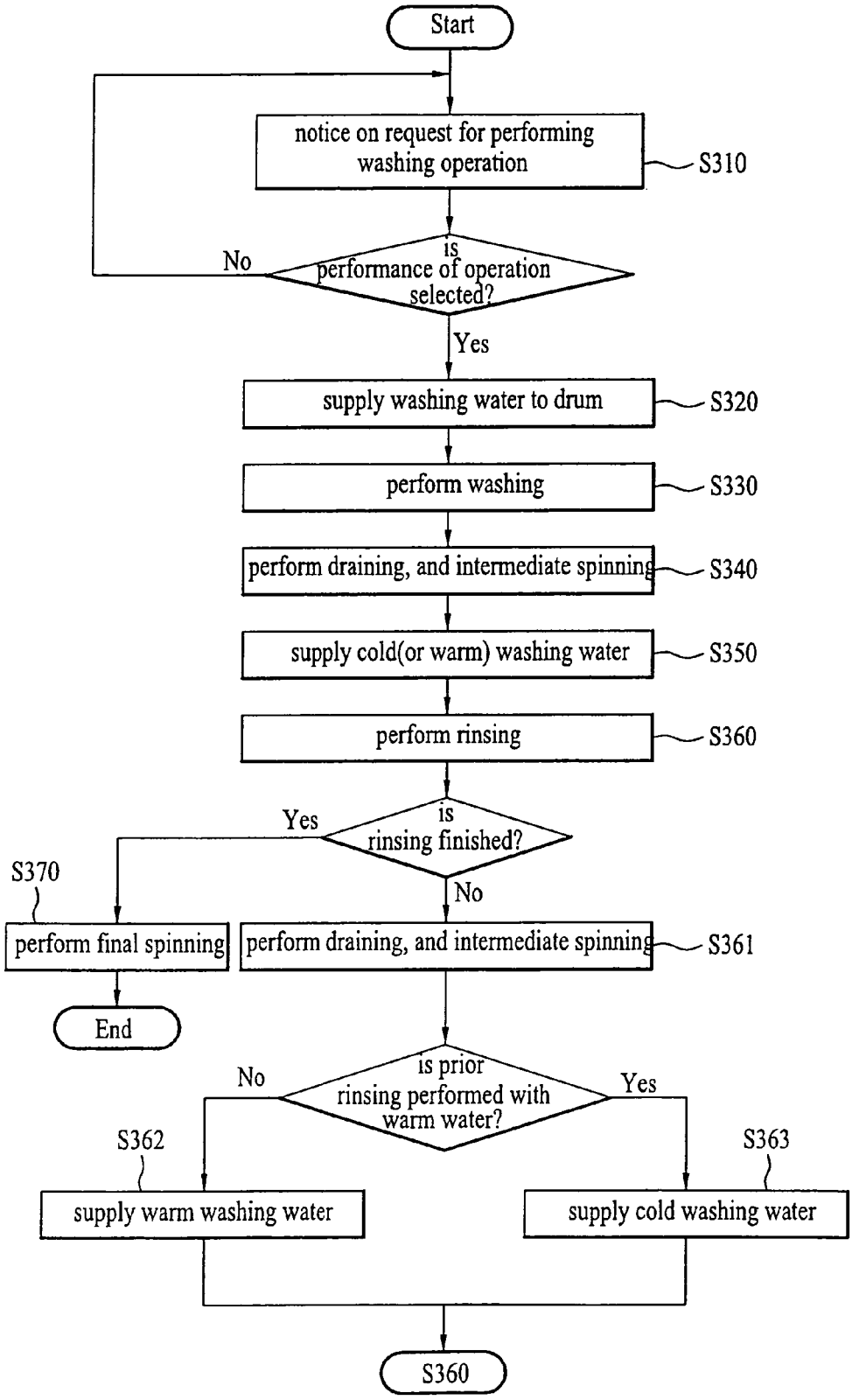
FIG. 7 illustrates a flow chart for describing an operating method in accordance with a third preferred embodiment of the present invention, schematically.

In the meantime, FIG. 7 illustrates a flow chart for describing an operating method in accordance with a third preferred embodiment of the present invention, schematically.

The operating method of a laundry device in accordance with a third preferred embodiment of the present invention suggests that rinsing of laundry is controlled so that the rinsing of the laundry is made smoother.

The operation method is made as a washing water supply step, a washing step, an intermediate spinning step, a rinsing step, and a final spinning step are progressed in succession, which will be described in detail according to above order.

At first, a controller (not shown) for controlling operation of the laundry device receives a request for performing operation from a user (S310).

In this instance, it is required that the laundry has been introduced into the inside of the drum 130.

If the user requests to perform washing, the controller performs the washing water supply step (S320).

The washing water supply step is a series of steps for supplying an appropriate amount of washing water to the inside of the drum 130 (S140), performed by controlling the water supply valve (not shown).

That is, as the water supply valve is operated, to open the water supply pipe (not shown), the washing water is supplied to an inside of the outer tub 120.

The appropriate amount of the washing water supplied to the drum 130 is a predetermined amount set according to an amount of the laundry.

It is preferable that an appropriate amount of detergent is also supplied to the inside of the drum 130 during the washing water is supplied to the drum 130 as the washing water supply step is progressed.

Upon finishing the washing water supply step according to above steps, the controller performs the washing step (S50) of rotating the drum 130 for a preset time period, to wash the laundry.

That is, the washing water circulates by rotation of the drum 130, and as dirt stuck to the laundry is separated by composite actions of a friction force between the water circulation and the laundry occurred following the circulation of the washing water, softening action of the detergent, and so on, the laundry is washed.

In this instance, a rotation direction, speed of the drum 130, a cycle progress time period, and so on for progressing the washing step may be controlled the same with a general washing cycle, or may be controlled different from above depending on necessity.

Upon finishing the washing step by above steps, the controller performs the intermediate spinning step for removing washing water from the laundry (S340).

The intermediate spinning step is performed by spinning the drum 130 at a high speed after draining residual washing water from the drum.

The spinning of the laundry is a step for enabling smoother rinsing of the laundry in the following rinsing step.

That is, rinsing of the laundry after forced removal of water containing detergent from the laundry provides significantly better rinsing effect.

If the intermediate spinning is finished, the controller performs the rinsing step for rinsing the laundry with washing water supplied newly at least twice.

In this instance, the laundry is in a state almost of all dirt (washing water containing detergent) is removed by the intermediate spinning.

It is preferable that rinsing sub-steps in the rinsing step are performed by using cold and warm washing water, alternately.

That is, one of the rinsing sub-steps is performed by using cold washing water, and the next rinsing sub-step is performed by using warm washing water.

More preferably, a first rinsing step is performed by supplying cold washing water (S360), and, upon finishing the first rinsing step, a second rinsing step (S360) is performed after supplying warm washing water (S362), and, upon finishing the second rinsing step, a third rinsing step is performed after supplying cold washing water (S363).

Of course, the first rinsing step may be performed by supplying warm washing water, and, upon finishing the first rinsing step, a second rinsing step may be performed after supplying cold washing water, and, upon finishing the second rinsing step, a third rinsing step may be performed after supplying warm washing water.

The rinsing step is performed while supplying cold water and warm water alternately, so that contraction and expansion of the laundry are made alternately, and repeatedly for smoother rinsing of various dirt from the laundry, and preventing the laundry from shrinking after finish of the washing in advance.

It is more preferable that re-contamination of the laundry in a next step caused by contaminated washing water is prevented by performing the intermediate spinning (S361) to discharge the detergent and dirt upon finishing each of the rinsing steps.

Upon finishing the rinsing step, the controller performs the final spinning step for removing water from the laundry, completely (S370).

The final spinning step is made by draining washing water from the outer tub 120 completely, and spinning the drum 130 at a high speed. According to this, the water is removed from the laundry by centrifugal force and, in succession, discharged to an inside of the outer tub 120 through the pass-through holes in the drum 130.

A spinning time period in the final spinning step is longer than a spinning time period in the intermediate spinning step.

As such a final spinning step is finished, washing of the laundry is finished.

The operation method in accordance with the third preferred embodiment of the present invention may further includes the sterilizing step suggested in the first preferred embodiment.

In the sterilizing step, the steam supplying part is operated before the washing water supply step is performed, to spray steam into the drum 130 having the laundry introduced thereto, to sterilize and soak the laundry.

Of course, it is preferable that the sterilizing step is performed for a time period enough to sterilize and soak the laundry in the drum 130, but shorter than a cycle time period of the washing step, at a temperature higher than a temperature at which sterilizing of the laundry is possible.

Moreover, the operation method in accordance with the third preferred embodiment of the present invention may further include the sterilizing step suggested in the second preferred embodiment of the present invention.

In the sterilizing step, after the intermediate spinning step is performed, the steam supplying part is operated, to spray steam into the drum 130 having the laundry introduced thereto, for sterilizing the laundry.

Of course, it is preferable that a temperature of steam supplied in the sterilizing step is the same with, or higher than the temperature at which the sterilizing of the laundry is possible, and the sterilizing step is performed for a time period enough to sterilize various microbes.

In the meantime, the operation method of a laundry device in accordance with a fourth preferred embodiment of the present invention suggests progressing a refresh step further for the laundry having the final spinning step finished in one of the operation methods in accordance with the foregoing preferred embodiments.

This is because it is preferable that a separate operation is further performed for removing the wrinkles from the laundry before taking out the laundry after the final spinning step is performed, considering that the laundry of which final spinning is made through the final spinning step has wrinkles caused by entangling during washing, rinsing and spinning.

The refresh step is a series of steps for removing a wrinkled state of the laundry, and progressed in a series of steps for supplying steam.

Figure 8:
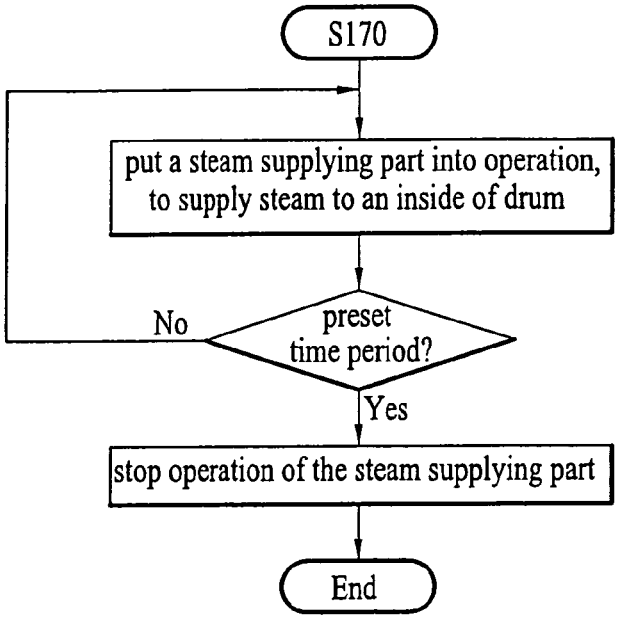
FIGS. 8 and 9 illustrate flow charts each for describing an operating method in accordance with a fourth preferred embodiment of the present invention, schematically.
Figure 9:
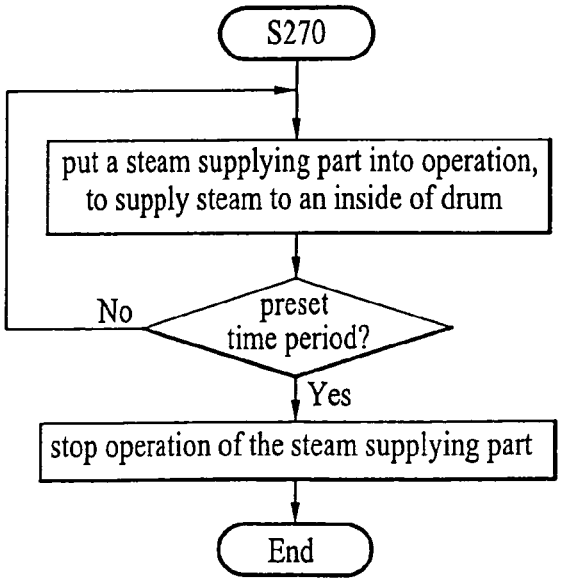

That is, by supplying high temperature steam to the laundry having the washing thereof finished, the wrinkles are removed from the laundry, and the laundry is sterilized as shown in the flow charts in FIGS. 8 and 9.

It is preferable that the steam is supplied at a temperature, for an example, 60° C. (preferably, 70° C.) higher than the temperature at which the sterilizing of the laundry is possible. This is because, even if the washing is finished, the laundry may have microbes remained thereon come from washing water used during washing. That is, it is the most preferable that the microbes remained on the laundry is sterilized completely by performing the sterilizing step again.

Moreover, it is preferable that a time period for supplying the steam is only a time period enough to refresh the laundry in the drum having washing thereof finished.

Particularly, it is preferable that an amount of the steam sprayed into the drum 130 is set to be a small amount not to make the laundry wet.

That is, object of the refresh step is to refresh, and sterilize the laundry, rather than the soaking of the laundry by the first steam supply.

In the meantime, the operation method of a laundry device in accordance with a fifth preferred embodiment of the present invention suggests the most preferable operation method having all of the first to fourth embodiments of the present invention combined therein.

The operation method is made by progressing a first sterilizing step, a washing water supply step, a washing step, an intermediate spinning step, a second sterilizing step, a rinsing step, a final spinning step, and a refresh step in succession.

Figure 10:
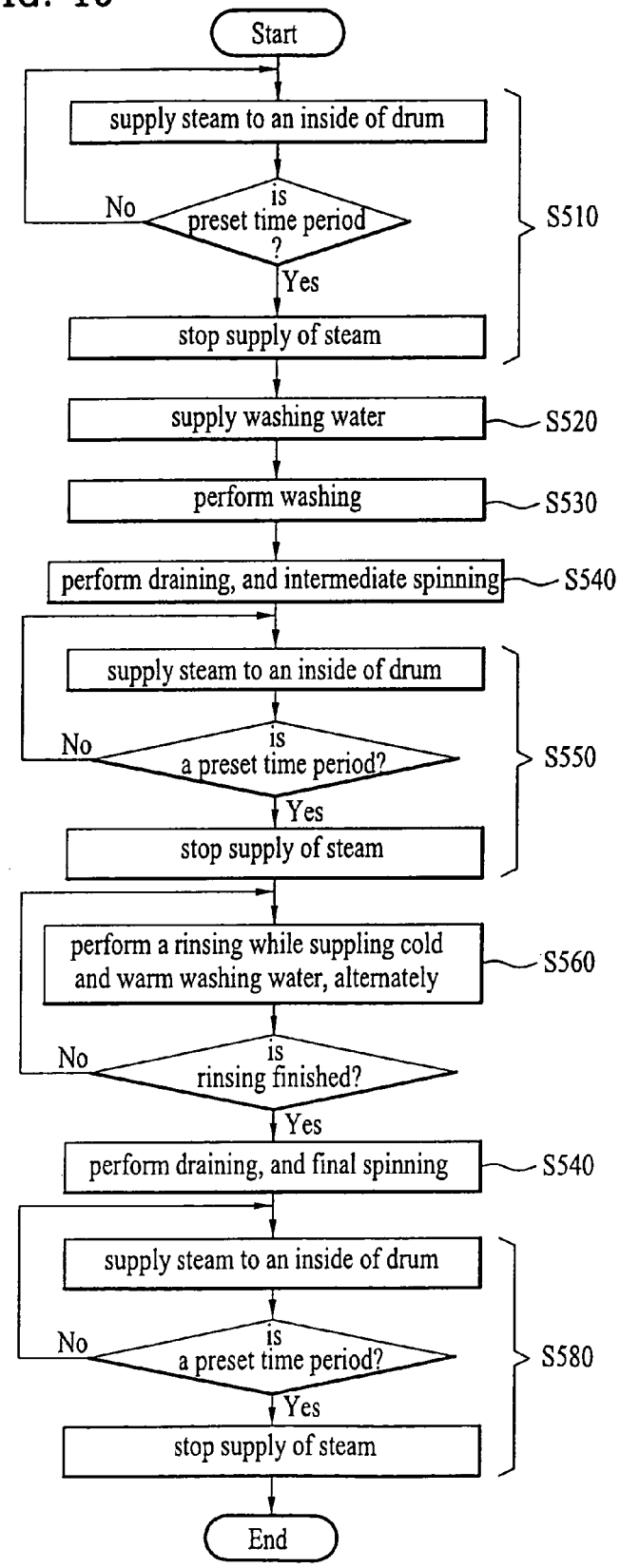
FIG. 10 illustrates a flow chart for describing an operating method in accordance with a fifth preferred embodiment of the present invention, schematically.

Above steps are progressed substantially the same with relevant steps in the first to fourth preferred embodiments of the present invention described above, which will be described for each of the steps briefly with reference to a flow chart in FIG. 10.

At first, in the first sterilizing step (S510), high temperature, humid steam is supplied to an inside of the drum 130 having the laundry introduced thereto, to sterilize and soak the laundry.

It is preferable that the first sterilizing step is performed for a time period enough to sterilize and soak the laundry in the drum 130, but shorter than a cycle time period of the washing step, at a temperature higher than the temperature at which sterilizing of the laundry is possible.

In the washing water supply step (S520), and the washing step (S530), washing water is supplied to the drum 130 having the laundry introduced thereto, and the drum 130 is rotated for a preset time period, to wash the laundry.

It is preferable that the washing water is supplied to an amount preset according to an amount of the laundry.

In the intermediate spinning step (S540), residual washing water is drained from the drum 130, and the drum 130 is spun at a high speed, for intermediate water extraction.

In the second sterilizing step (S550), steam is sprayed into the drum 130, to sterilize the laundry having passed through the intermediate spinning step with high temperature steam.

It is preferable that a temperature of the steam supplied in the second sterilizing step is the same with, or higher than a temperature at which sterilizing of the laundry is possible, and the second sterilizing step is performed for a time period enough to sterilize various microbes.

In the rinsing step (S560), the laundry having the second sterilizing finished is rinsed at least two times with cold and warm water, alternately.

The rinsing step is made by progressing a first rinsing step in which rinsing is performed by using cold washing water, a second rinsing step in which rinsing is performed by using warm washing water upon finishing the first rinsing step, and a third rinsing step in which rinsing is performed by using cold washing water upon finishing the second rinsing step in succession.

In the final spinning step (S570), the drum 130 is rotated at a high speed, for removing washing water from he laundry having the rinsing thereof finished, completely.

In the refresh step (S580), steam is sprayed into the drum 130, to make final sterilization and refresh of the laundry.

It is preferable that the steam supplied in the refresh step is supplied at a temperature, for an example, 60° C. (preferably, 70° C.) higher than the temperature at which the sterilizing of the laundry is possible, and it is preferable that a time period during which the steam is supplied is only a time period enough to refresh the laundry in the drum having washing thereof finished.

Particularly, it is preferable that an amount of the steam sprayed into the drum 130 is set to be a small amount not to make the laundry wet.

That is, object of the refresh step is to refresh, and sterilize the laundry, rather than the soaking of the laundry by the first steam supply.

[Industrial Applicability]

The operation method of a laundry device in accordance with a first preferred embodiment of the present invention has an industrial applicability because it is a control method for supplying steam before washing of laundry is started.

The operation method of a laundry device in accordance with a second preferred embodiment of the present invention has an industrial applicability because it is a control method for supplying steam before rinsing of laundry is started.

The operation method of a laundry device in accordance with a third preferred embodiment of the present invention has an industrial applicability because it is a control method for performing rinsing of laundry with warm water and cold water, alternately.

The operation method of a laundry device in accordance with a fourth preferred embodiment of the present invention has an industrial applicability because it is an overall control method for washing of laundry.

The operation method of a laundry device in accordance with a fifth preferred embodiment of the present invention has an industrial applicability because it is a control method for supplying steam after final spinning of laundry is finished.

The invention claimed is:

1. A method for operating a laundry device comprising:

supplying washing water to a tub or drum having laundry introduced thereto;

rotating the drum for a preset time period during washing;

draining residual washing water while performing intermediate spinning of the drum at a high speed for making an intermediate extraction of water when the washing is finished;

supplying steam into the tub or drum having the laundry thereto to sterilize or sanitize the laundry when the intermediate spinning is finished and before filling of water to rinse;

rinsing at least once with washing water supplied to the tub or drum when supplying the steam to sterilize or sanitize the laundry is finished; and performing a final spinning cycle when rinsing is finished.

2. The method as claimed in claim 1, wherein the supplying of steam comprises supplying steam at a temperature that can kill various microbes in the laundry.

3. The method as claimed in claim 1, wherein the supplying of steam comprises supplying steam for a second preset time period long enough to kill various microbes.

4. The method as claimed in claim 1, further comprises supplying steam to the tub or drum to refreshen the laundry after the final spinning cycle is finished.

5. The method as claimed in claim 2, wherein the temperature is higher than 60° C.

6. The method as claimed in claim 3, wherein the second present time period is a time period of 3-10 minutes.

7. The method as claimed in claim 1, wherein the rinsing comprises :

a first rinsing step for performing rinsing with cold washing water, a second rinsing step for performing rinsing with warm washing water after finish of the first rinsing step, and a third rinsing step for performing rinsing with cold washing water.

8. The method as claimed in claim 7, further comprising an intermediate step between the first and the second rinsing step, and between the second and the third rinsing step.

* * * * *